US005167095A

United States Patent [19]

Berger

[11] Patent Number: 5,167,095

[45] Date of Patent: Dec. 1, 1992

[54] ECCENTRIC GRINDING MACHINE

[75] Inventor: Günther Berger, Notzingen, Fed. Rep. of Germany

[73] Assignee: Robert Bosch GmbH, Stuttgart, Fed. Rep. of Germany

[21] Appl. No.: 720,842

[22] PCT Filed: Dec. 4, 1990

[86] PCT No.: PCT/DE90/00936

§ 371 Date: Jul. 11, 1991

§ 102(e) Date: Jul. 11, 1991

[87] PCT Pub. No.: WO91/09705

PCT Pub. Date: Jul. 11, 1991

[30] Foreign Application Priority Data

Dec. 12, 1989 [DE] Fed. Rep. of Germany ..... 3942301

[51] Int. Cl.[5] ..... B24B 23/03

[52] U.S. Cl. ..... 51/170 MT; 51/119

[58] Field of Search ..... 51/170 R, 170 T, 170 MT, 51/119, 120, 109 R; 15/49.1

[56] References Cited

U.S. PATENT DOCUMENTS

| | | | |
|---|---|---|---|
| 3,550,324 | 12/1970 | Gerry | 51/170 T |
| 4,754,575 | 7/1988 | Schneider | 51/170 MT |
| 4,759,152 | 7/1988 | Berger | 51/170 MT |

FOREIGN PATENT DOCUMENTS

| | | | |
|---|---|---|---|
| 3602571 | 7/1987 | Fed. Rep. of Germany | 51/170 T |
| 3609441 | 9/1987 | Fed. Rep. of Germany | 51/170 MT |
| 3615799 | 11/1987 | Fed. Rep. of Germany | 51/170 MT |
| 3727487 | 3/1989 | Fed. Rep. of Germany . | |

*Primary Examiner*—Roscoe V. Parker
*Attorney, Agent, or Firm*—Michael J. Striker

[57] ABSTRACT

In an eccentric grinding machine with eccentric gearing in which a more or less coarse grinding can be produced by means of a switchable rolling gearing, the selected type of grinding is externally visible also when the machine is running. The optical display of the grinding picture, according to the invention, makes use of the effect by which points on the grinding disk describe cycloids during operation. During the cycloidal movement of the grinding disk, certain points on the latter remain stationary for a short time at cusp points. At this moment, markings which show the type of grinding movement are visible. The markings are located in the radius on the grinding disk on which points are located which describe common cycloids, that is, cycloids which are neither lengthened nor shortened.

13 Claims, 1 Drawing Sheet

ECCENTRIC GRINDING MACHINE

BACKGROUND OF THE INVENTION

The present invention relates to an eccentric grinding machine with an eccentric gearing between its drive and its grinding disc. Such a machine comprising a grinding disk is known from DE-OS 36 09 441 (U.S. Pat. No. 4,759,152). It carries two toothed rims of different dimensioning on its rear side, which toothed rims abrade with varying degrees of intensity at the machined workpiece with rotational movement of different speeds. However, it is difficult to determine when the machine is running whether or not the eccentric grinding machine is producing a coarse or a fine grinding.

SUMMARY OF THE INVENTION

Accordingly, it is an object of the present invention to provide an eccentric grinding machine which avoids the disadvantages of the prior art.

More particularly, it is an object of the present invention to provide such a grinding machine in which a grinding picture is displayed during operation when the grinding disc is rotating.

In keeping with these objects and with others which will become apparent hereinafter, one feature of the present invention resides, briefly stated, in that a grinding disc carries markings in form of characters or pictographs to designate a type of grinding movement, and the markings are arranged on a circular mark with a radius of a reference circle of a respective friction or toothed rim so as to be readable also while the grinding disc is rotating.

In accordance with an advantageous embodiment of the present invention, the markings are applied on an abrasive surface of the grinding disc. A particular advantage consists in the design of the friction or toothed rims by means of which the grinding disk is driven in such a way that cycloids having an integral number of nodes are formed on the grinding disk. During the rotation of the grinding disk this results in a stationary cycloid picture, so that a stationary symbol or a stationary character is visible when correspondingly marked. A stationary cycloid picture also results e.g. when the number of nodes is a half-integer, wherein the distances between the stationary nodes are reduced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
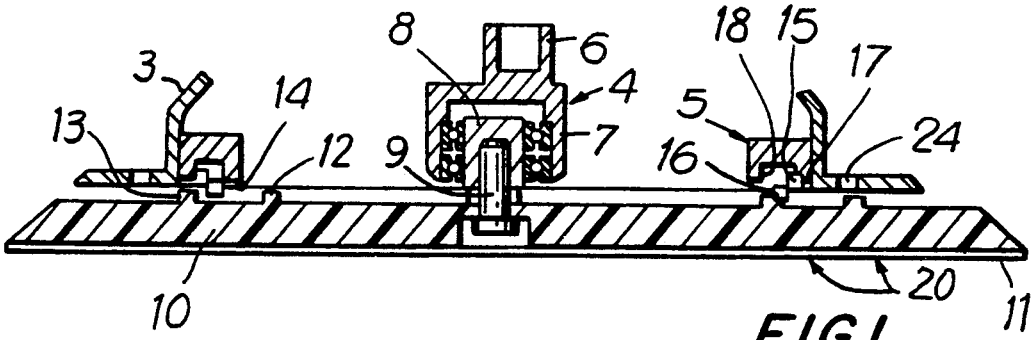
FIG. 1 is a view showing a partial cross-section of an eccentric grinding machine in accordance with the present invention.

An eccentric grinding machine has a housing 3, a central eccentric gearing 4 and a rolling gearing 5, as described e.g. in DE-OS 36 09 441. A rolling gearing 5 is securely connected with the housing 3 in part. The eccentric gearing 4 has a connection piece 6 which is connected with a shaft of a drive motor, not shown. An eccentric sleeve 7 is connected eccentrically with the connection piece 6, and roller-supported supporting journal 8 is rotatably supported in the eccentric sleeve 7. A grinding disk 10 is securely connected with the supporting journal 8 by means of a screw 9. The grinding disk 10 is provided with an abrasive surface, particularly abrasive paper 11, on the side remote of the eccentric gearing 4. The abrasive paper 11 can be glued on or connected with the grinding disk 10 by means of a loop-and-hook connection. The grinding disk 10 carries two toothed rims 12 and 13 of different diameters on the side facing the eccentric gearing 4. The teeth of the toothed rims 12 and 13 face one another. A toothed ring 14 engages in one of the toothed rims 12, 13. The toothed ring 14 has an external toothing 15 and an internal toothing 16 which lie in two different planes in the axial direction. In FIG. 1 the internal toothing 16 of the toothed ring 14 engages in the toothed rim 12 of the grinding disk 10. The external toothing 15 of the change ring 14 meshes with a toothed rim 17 of the housing. The toothed rim 17 has an internal toothing and is securely connected with the housing 3. The toothed ring 14 can be turned so that its external teeth 15 mesh with the toothed rim 13 of the grinding disk 10 and the internal teeth 16 of the toothed ring 14 mesh with a toothed rim 18 of the housing. The toothed rim 18 has external teeth and is fastened at the housing 3.

The toothed ring 14 is a part of the rolling gearing 5 which causes the grinding disk 10 to roll relative to the housing 3 in a compulsory rotational movement as a result of the deflection of the grinding disk 10 caused by the eccentric gearing 4. The rolling movement is effected either in the same direction as the eccentric movement, wherein the toothed rim 13 of the grinding disk rolls at the toothed ring 14, or the rotational movement is effected opposite the eccentric movement. In so doing, the toothed rim 12 rolls at the toothed ring 14, as is shown in FIG. 1. The type of operation shown in FIG. 1 results in a fine grinding with little abrasion. The other type of operation produces a coarse grinding with high abrasion.

Figure 2:
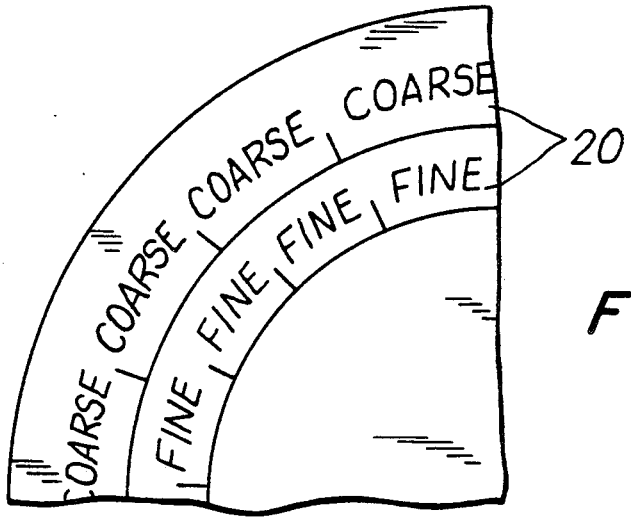
FIG. 2 is a view showing a grinding disc of the inventive eccentric grinding machine.

Points on the grinding disk describe epicycloids during the operation of the eccentric grinding machine in fine grinding and hypocycloids during coarse grinding. In so doing, common cycloids are formed directly at the reference circle of the toothed rims 12 and 13, while these cycloids are formed so as to be stretched or looped radially outward and radially inward. Markings 20 which show the type of grinding movement lie directly opposite the toothed rims 12 and 13 on circular arcs with the radius of the reference circles. The words "COARSE" and "FINE" are printed on the abrasive paper as markings, as is shown in FIG. 2. However, other characters or pictographs can also be used.

Figure 3:
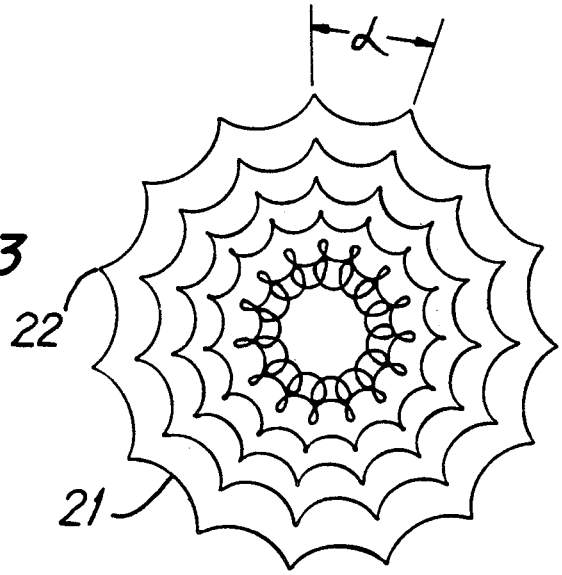
FIG. 3 is a view showing a grinding picture.

FIG. 3 shows a grinding picture produced by the grinding disk 10 in coarse grinding operation. The hypocycloids 21 which are formed with a quantity n of fifteen cusp points or nodes 22 are clearly shown. The nodes n are located at a distance from one another corresponding to an angle $\alpha$ of rotation of 24°. The angle $\alpha$ of rotation is calculated at $$\alpha = 360°/n. \quad (1)$$

The markings 20 are arranged on the radius of the common hypocycloids at a distance from one another corresponding to the angle of rotation.

An integral number n of nodes 22 results, as shown in FIG. 3, when the reference circle circumference $U_A$ of the toothed rim or the external toothing 15 of the toothed ring 14 of the rolling gearing 5 has the following relationship to the reference circle circumference $U_T$ of the toothed rim 13 of the grinding disk 10:

$$U_A = U_T(1 - x/n) \text{ for } U_A > U_T \quad (2),$$

wherein x is an integer, preferably 1.

Stationary cycloids result on the grinding disk 10 when there is an integral number of nodes 22. The markings 20 then appear as stationary symbols or characters. An integral number n of nodes 22 results when the quotient from the number of degrees of the full circle—by means of the number of degrees of the angle $\alpha$ of rotation—is an integer. When this quotient is a half-integer, e.g. 15.5, more stationary nodes, thirty-one in the example, are formed in the grinding picture.

The grinding picture from FIG. 3 can be produced with the use of toothed wheels if the toothed rim 13 of the grinding disk 10 has sixty teeth and the external toothing 15 of the toothed ring 14 has fifty-six teeth.

The markings 20 can also be printed on the back of the grinding disk 10 on circular arcs with the radii of the reference circle of the toothed rims 12 and 13, instead of on the abrasive paper 12. In this case, a window 24 can be arranged at the housing 3 of the eccentric grinding machine 2 through which e.g. the marking 20 for coarse grinding can be seen, as in FIG. 1.

The functioning of the eccentric grinding machine is described in detail in DE-OS 36 09 441. The optical display of the grinding picture, according to the invention, is brought about in that the grinding disk 10 stops for a short time during its rolling movement accompanied by the formation of the nodes 22, so that the markings 20 arranged on it are visible at that moment. When one marking 20 is arranged for every node 22, a physical marking 20 occurs continuously at the virtual location of the next during the rolling movement. This takes place with every marking 22, so that the optically visible display is strengthened in that this large quantity of markings 20 is repeatedly made visible at the same virtual location on the grinding disk.

The invention is not limited to the embodiment example. Instead of a grinding disk with two toothed rims, two grinding disks with only a single toothed rim can be used, for example, which grinding disks roll at the toothing, which is fixed with respect to the housing, approximately according to DE-OS 36 15 799 (=U.S. Pat. No. 4,754,575). In this case, a separate grinding disk is required for every grinding movement.

I claim:

1. An eccentric grinding machine, comprising a drive; a grinding disk provided with an abrasive surface for grinding a workpiece and also with a rim; an eccentric gearing provided between said drive and said grinding disc and having a further rim cooperating with said rim of said grinding disk so that said rim of said grinding disk performs a rolling movement over said rim of said eccentric gearing whereby points on said grinding disk describe cycloids during the rolling movement; and a plurality of markings provided on said grinding disk to designate a type of a grinding movement, said markings being arranged on a circular arc with a radius of a reference circle of said toothed rim of said grinding disk so as to be readable while said grinding disk is rotating.

2. An eccentric grinding machine as defined in claim 1, wherein said rim of said grinding disk and said rim of said eccentric gearing are formed as friction rings.

3. An eccentric grinding machine as defined in claim 1, wherein said rim of said grinding disk and said rim of said eccentric gearing are formed as toothed rings.

4. An eccentric grinding machine as defined in claim 1, wherein said markings on said grinding disk are formed as characters.

5. An eccentric grinding machine as defined in claim 1, wherein said markings on said grinding disk are formed as pictographs.

6. An eccentric grinding machine as defined in claim 1, wherein said markings are arranged on said abrasive surface of said grinding disk.

7. An eccentric grinding machine as defined in claim 1, wherein said eccentric gearing has a toothing, a reference circle circumference of said toothing and a reference circle circumference of said rim of said grinding disk having a relationship to one another such that points on said grinding disk describe epicycloids and hypocycloids.

8. An eccentric grinding machine as defined in claim 7, wherein said epicycloids and hypocycloids have an integral number of nodes.

9. An eccentric grinding machine as defined in claim 7, wherein said grinding disk has a center, said markings being located at such a distance from said center of said grinding disk in which points are located which describe common cycllids which are neither lengthened nor shortened.

10. An eccentric grinding machine as defined in claim 7, wherein said reference circle circumference of said rim of said eccentric gearing has the following relationship to said reference circle circumference of said rim of said grinding disk:

$$U_A = U_T(1 - x/n) \text{ for } U_A > U_T,$$

wherein x is an integer, and n is a quantity of said nodes of said cycloids formed on said grinding disk.

11. An eccentric grinding machine as defined in claim 10, wherein said integer is 1.

12. An eccentric grinding machine as defined in claim 7, wherein said markings are arranged on said grinding disk at a distance corresponding to a multiple of an angle of rotation which results in $$\alpha = 360°/n$$

wherein n is a quantity of said nodes.

13. An eccentric grinding machine as defined in claim 1, wherein said markings include words "COARSE" and "FINE".

* * * * *